US007040128B2

(12) United States Patent
McCallum et al.

(10) Patent No.: US 7,040,128 B2
(45) Date of Patent: May 9, 2006

(54) TRI-AXIS HARD DIE CHECK

(75) Inventors: Scott McCallum, St. Clair, MI (US); Paul Kleine, Rochester Hills, MI (US); Rick Hurst, Rochester Hills, MI (US)

(73) Assignee: Syron Engineering & Manufacturing, LLC, Saline, MI (US)

( * ) Notice: Subject to any disclaimer, the term of this patent is extended or adjusted under 35 U.S.C. 154(b) by 113 days.

(21) Appl. No.: 10/801,412

(22) Filed: Mar. 16, 2004

(65) Prior Publication Data

US 2005/0000264 A1 Jan. 6, 2005

Related U.S. Application Data

(60) Provisional application No. 60/484,506, filed on Jul. 2, 2003.

(51) Int. Cl.
*B21D 43/05* (2006.01)

(52) U.S. Cl. ..... 72/31.01; 72/405.01; 33/562; 33/655; 33/1 M

(58) Field of Classification Search ..... 72/31.01, 72/405.01; 33/201, 626, 562, 655, 1 M, 33/563, 565, 567
See application file for complete search history.

(56) References Cited

U.S. PATENT DOCUMENTS 5,000,021 A * 3/1991 Nakamura et al. ..... 72/19.5
6,272,892 B1 * 8/2001 Ozaki et al. ..... 72/4
6,845,646 B1 * 1/2005 Goto ..... 72/20.1

* cited by examiner

*Primary Examiner*—Daniel C. Crane
(74) *Attorney, Agent, or Firm*—Carlson, Gaskey & Olds

(57) ABSTRACT

A method and device for checking clearance between a stamping die includes a template representative of relative movement between the stamping die and end tool. A template including a surface representing movement of the end tool relative to the stamping die is positioned relative to the stamping die. The position is indicative of a location of the end tool during operation of the stamping die. Contact between the template and the stamping die along the surface representing movement indicates potential contact between the end tool and the stamping die during operation.

15 Claims, 8 Drawing Sheets

TRI-AXIS HARD DIE CHECK

This application claims priority to U.S. provisional application Ser. No. 60/484,506 filed Jul. 2, 2003.

BACKGROUND OF THE INVENTION

This invention generally relates to a stamping die check assembly, and specifically to a die check assembly for checking clearances between an end tool of a workpiece transfer system and a stamping die.

Conventional stamping operations include a series of stamping dies arranged such that a work piece is moved from one stamping die to another until a desired shape is obtained. Stamping operations are often employed for high volume applications such as are required in the automotive industry. At one time, stamping die operations employed human operators to transfer work pieces, between stamping dies. Current stamping operations utilize custom designed and assembled workpiece transfer systems.

Typically, a workpiece transfer system comprises an arm mounted to a shuttle. The shuttle moves between two stamping dies. An end tool disposed on the arm engages the workpiece. The end tool can include a gripper that clamps onto the workpiece or a passive holder known in the art as a "shovel." The shovel corresponds to a feature on the workpiece to hold the workpiece during movement between stamping dies.

Typically, each stamping die includes an upper and lower part. The upper part lifts away from the lower part to allow removal of the workpiece. Operation of the workpiece transfer system begins with the end tool in a retracted position. The arm advances toward the stamping die from the retracted position as the upper stamping die begins to lift from the lower die. Movement of the transfer system corresponds with movement and the cycle time of the stamping die. It is desirable to reduce the cycle time in order to speed production and increase efficiency. For this reason, the movement of the workpiece transfer system is optimized to begin movement as the stamping die begins to open.

Movement of the end tool begins even before the upper die has fully cleared the lower die. Precious time would be wasted if the end tool remained stationary until the upper die was completely clear. For this reason, movement between the upper die and the end tool is carefully orchestrated to achieve an optimal cycle time. As the upper stamping die lifts from the lower stamping die, the end tool is advanced toward the lower die. The end tool proceeds into the stamping die at a speed relative to movement of an upper die section such that the end tool reaches into the lower die at substantially the instant the end tool clears the upper die.

Much effort is taken to assure that movements between the stamping die and the transfer system are properly synchronized. However, in many instances, different vendors build the stamping line and the transfer line. Therefore, often the first time that the transfer system and the stamping die line are operated together is during a production part approval run. At such a late point of process development, errors or unforeseen obstructions can result in costly delays and repairs.

Accordingly, it is desirable to design and develop a method and device for checking the relationship between a transfer system and a die to confirm a process design and detect possible interference between the transfer tooling and a stamping die.

SUMMARY OF THE INVENTION

The present invention is a method and device for checking clearances and relative motion between a stamping die and an end tool for a workpiece transfer system.

The method and device include templates representing relative movement between the stamping die and the workpiece transfer system. A template representative of relative movement between the end tool and the stamping die is positioned on the end tool or the stamping die. The template includes a surface representing a minimum desired clearance between the end tool and the stamping die. Contact between any portion of the template and the stamping die indicates a possible interference condition. Early detection of possible interference conditions decreases costs associated with correcting the interference condition and provides for correction of any possible interference conditions before experiencing costly delays or damage.

Accordingly, the method and device of this invention confirms the relative movement between a transfer system and a stamping die, and detects possible interference conditions before operation of the stamping and transfer system.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

The present invention is a method and device for confirming clearances between an end tool 20 and a stamping die 14 before the stamping die 14 and the end tool 20 are placed into the production environment.

Figure 1:
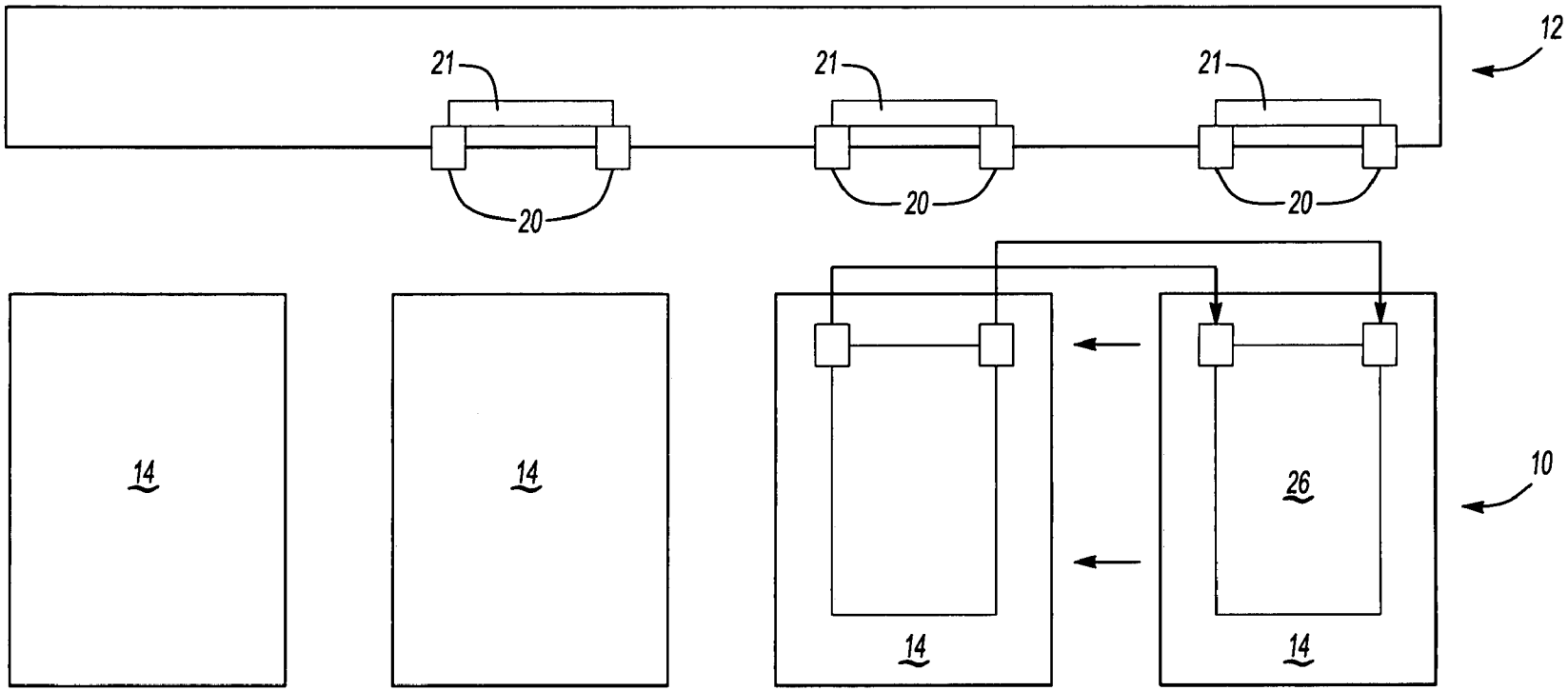
FIG. 1 is a schematic view of a stamping line and workpiece transfer system.
Figure 2:
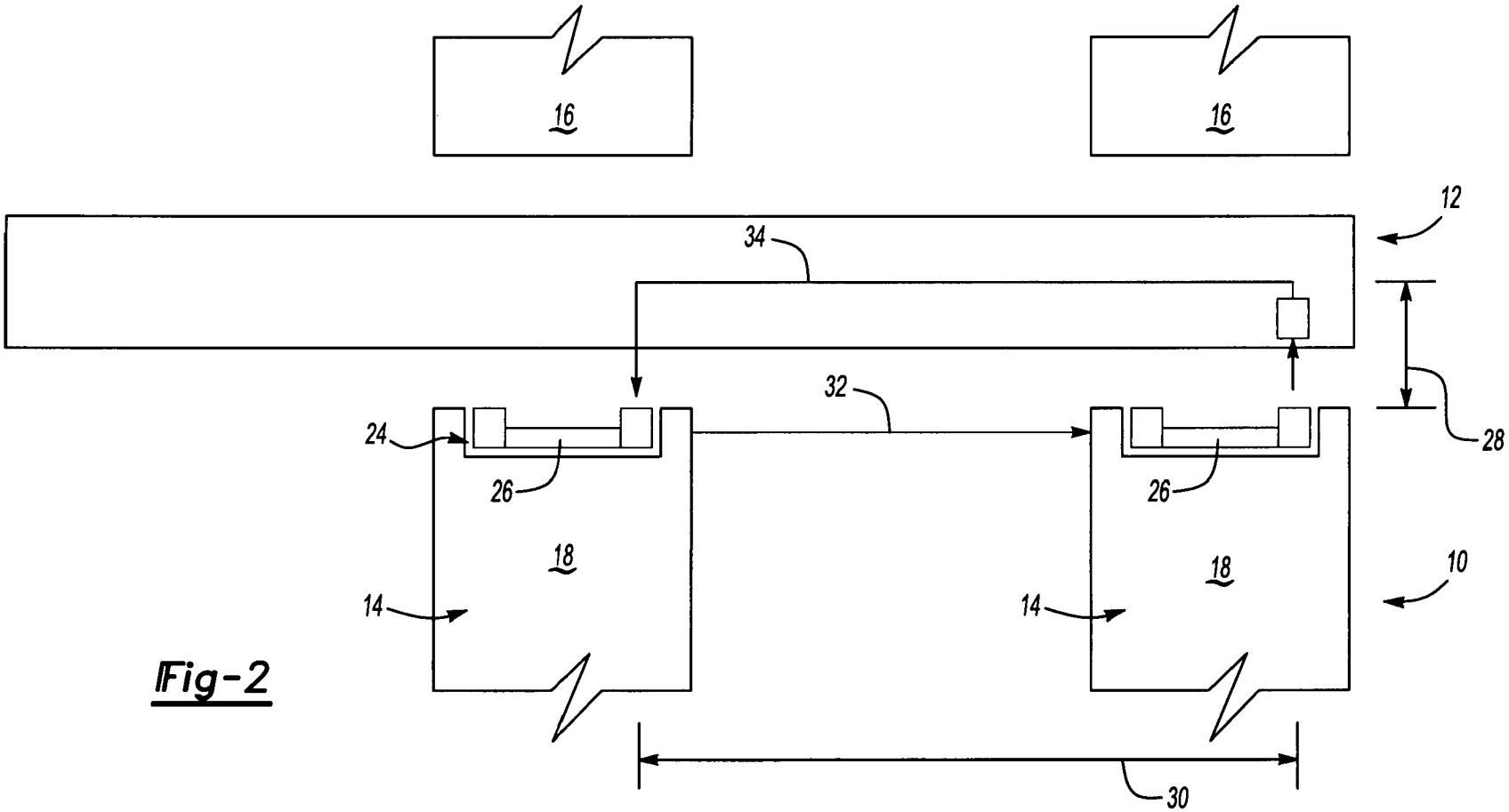
FIG. 2 is another schematic view of operation of a stamping line and workpiece transfer system.

Referring to FIGS. 1 and 2, a stamping assembly line is schematically shown at 10 and includes several sequentially positioned stamping dies 14. Each stamping die 14 forms a workpiece 26 into a specific shape that corresponds to the stages of forming the workpiece beginning with an initial shape and resulting in a final desired shape. The workpiece 26 is moved between stamping dies 14 by a workpiece transfer system 12. The workpiece transfer system 12 includes one or more shuttles 21. Each shuttle 21 includes an end tool 20. The end tool 20 extends into the stamping die 14 to grasp and move the workpiece 26 from one stamping die to a next stamping die 14.

Each stamping die 14 includes an upper portion 16 and a lower portion 18 that cooperate to form a cavity 24 therebetween (FIG. 2). The lower portion 18 remains stationary and the upper portion 16 moves upward to allow removal of the workpiece 26. The end tool 20 grasps the workpiece 26, lifts it from the cavity 24, and transfers it to the bottom portion 18 of the next stamping die 14. The end tool 20 then releases the workpiece 26 and returns to the first stamping die 14 to grasp the next workpiece 26.

Figure 3:
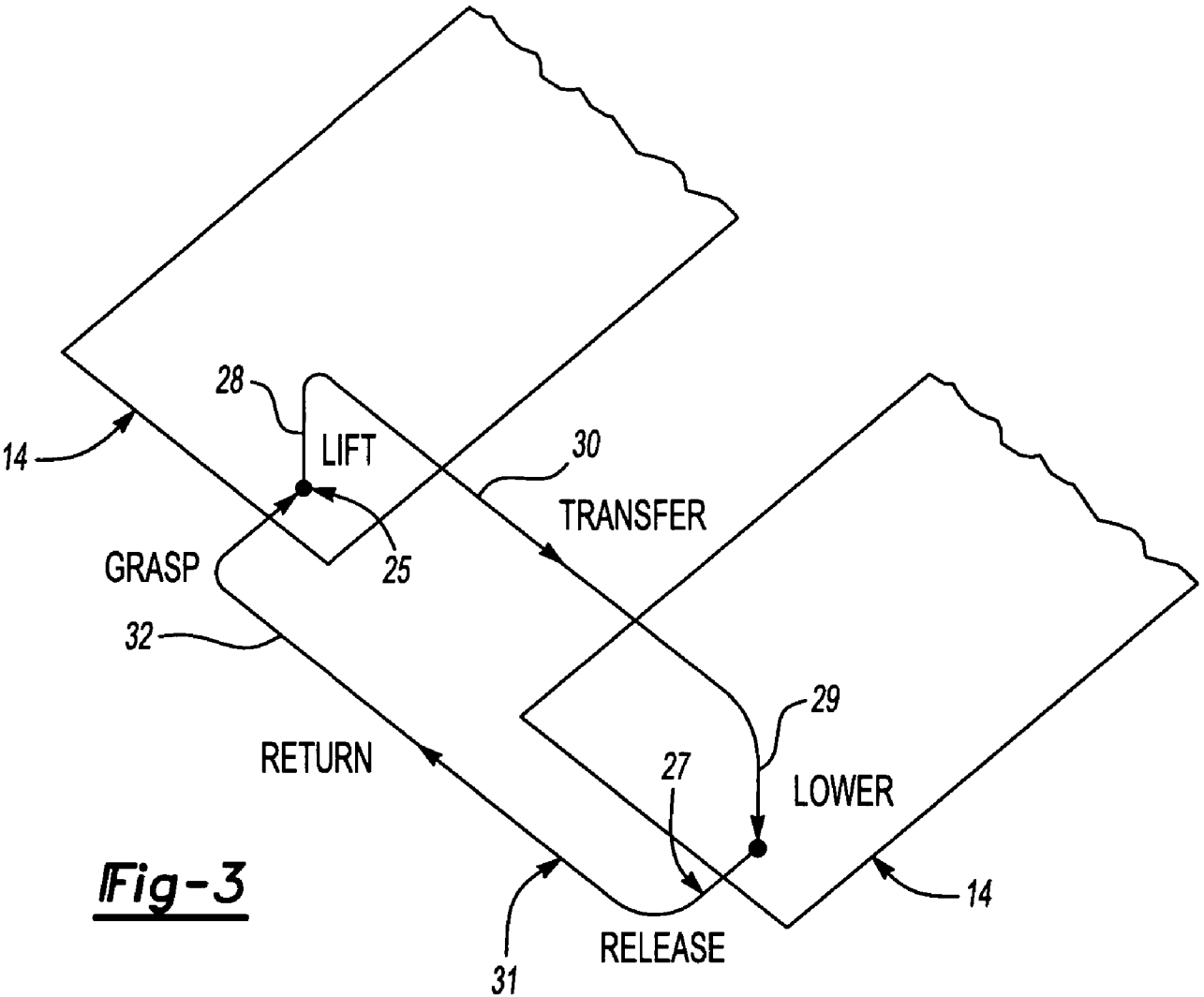
FIG. 3 is a schematic view illustrating the path of travel of an end tool.

Referring to FIG. 3, the motion of the end tool 20 during transfer between stamping dies is schematically illustrated as a continuous path 31. The path 31 represents motion of one portion of the end tool 20 between stamping dies 14. The end tool 20 remains in constant motion during operation of the stamping line 10. The path 31 includes a grasping position 25, a lift portion 28, a transfer portion 30, a lower portion 29, a release position 27 and a return portion 32. Beginning from the grasp position 25 the end tool 20 lifts the workpiece 26 and travels along lift portion 28 of the path 31. The lift portion 28 transitions smoothly into the transfer portion 30 to move the workpiece 26 to the next stamping die 14. The transfer portion 30 transitions into the lower portion 29 to the release position 27. The workpiece 26 is released and the end tool 20 proceeds along the return portion 32 of the path 31 back toward the grasp position 25. This movement is continuously repeated during operation of the transfer assembly 12.

Figure 4A:
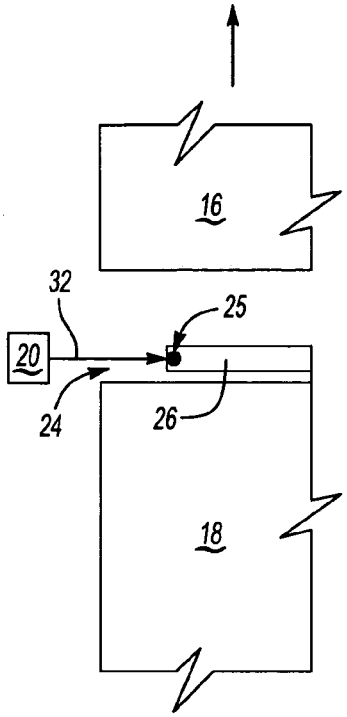
FIG. 4A is a schematic view illustrating relative movement of the end tool prior to entering a stamping die.
Figure 4B:
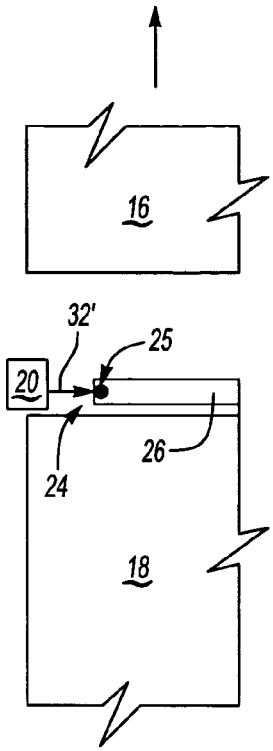
FIG. 4B is a schematic view illustrating relative movement of the end tool entering the stamping die.
Figure 4C:
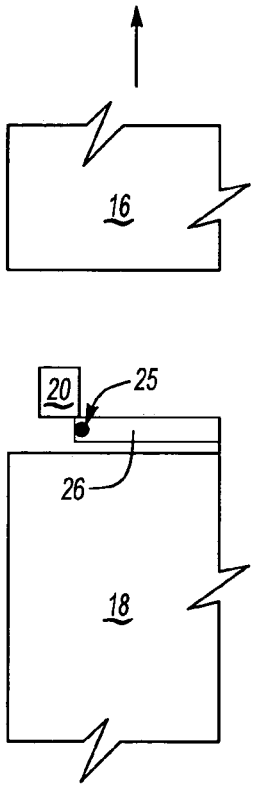
FIG. 4C is a schematic view illustrating the end tool grasping a workpiece.
Figure 4D:
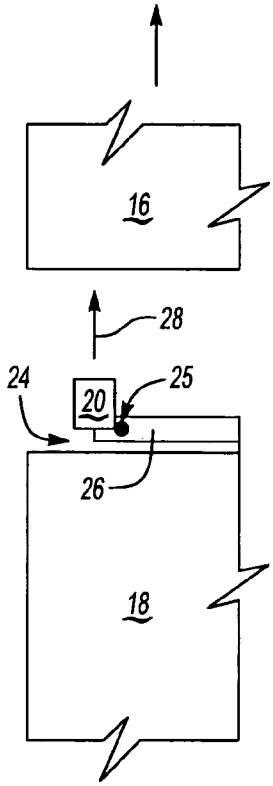
FIG. 4D is a schematic view illustrating the end tool lifting the workpiece from the stamping die.

Referring to FIGS. 4A–D, operation of the end tool 20 is shown in sequence from a side view. Beginning on the return portion 32 of the path 31, the end tool 20 moves toward the grasp position 25 to grasp the workpiece 26 (FIG. 4A). As the upper portion 16 begins lifting from the lower stamping die 18, the end tool 20 advances within the stamping die toward the grasp position 25 (FIG. 4B). Timing between movement of the end tool 20 and the upper portion 16 is such that the end tool 20 will immediately enter the cavity 24 once the upper stamping die 16 has cleared the path 31. The end tool 20 moves to the grasp position 25, grasps the workpiece 26 (FIG. 4C), and begins lifting the workpiece 26 from the lower die 18 (FIG. 4D). This orchestrated movement between the end tool 20 and the upper portion 16 provides for an optimal system cycle time.

Figure 5:
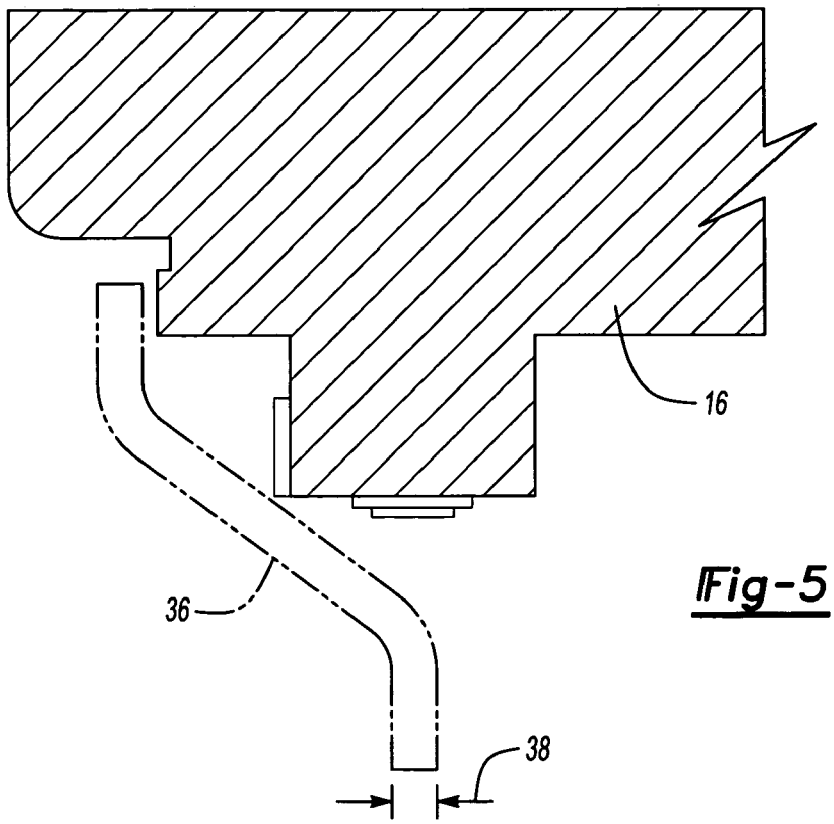
FIG. 5 is a schematic view of a motion curve representing relative movement between the upper stamping die and the end tool.
Figure 6:
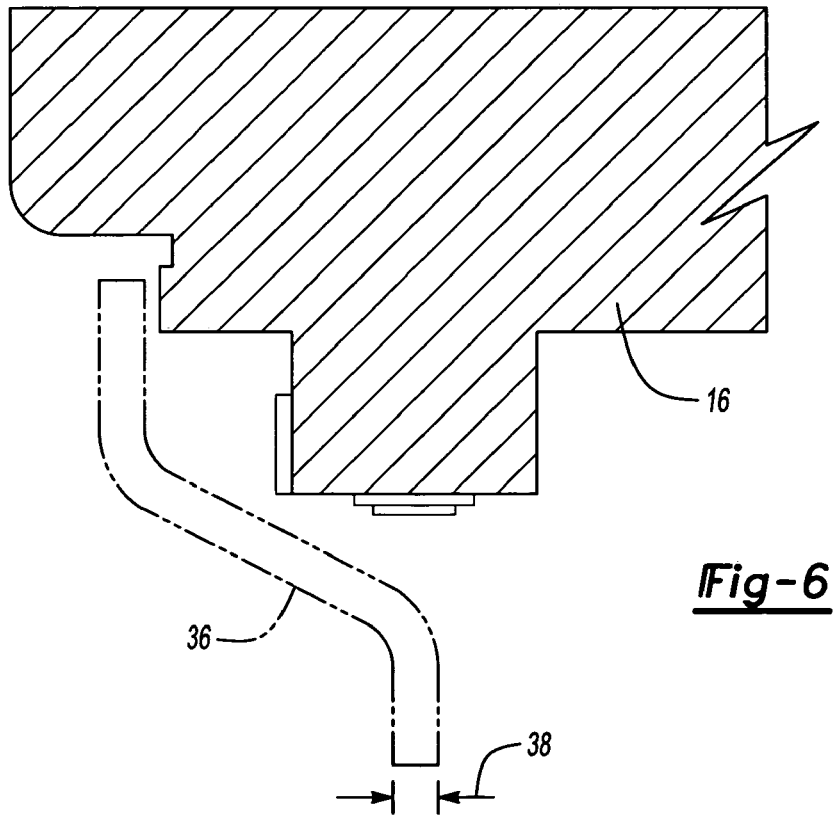
FIG. 6 is another schematic view of a motion curve representing relative movement between the upper stamping die and the end tool.

Referring to FIGS. 5 and 6, the relative motion between the end tool 20 and the upper die 16 is shown as a relative motion curve 36. Relative motion curve 36 includes a tolerance band 38. The tolerance band provides a minimum clearance between the end tool 20 and the stamping die 16. FIG. 5 illustrates the motion curve 36 for movement of the end tool 20 into the die 14 to grasp the workpiece 26 as the upper die 16 moves upward. FIG. 6 illustrates the curve 37 for the return motion of the end tool 20 exiting as the upper stamping die 16 is lowering.

Figure 7:
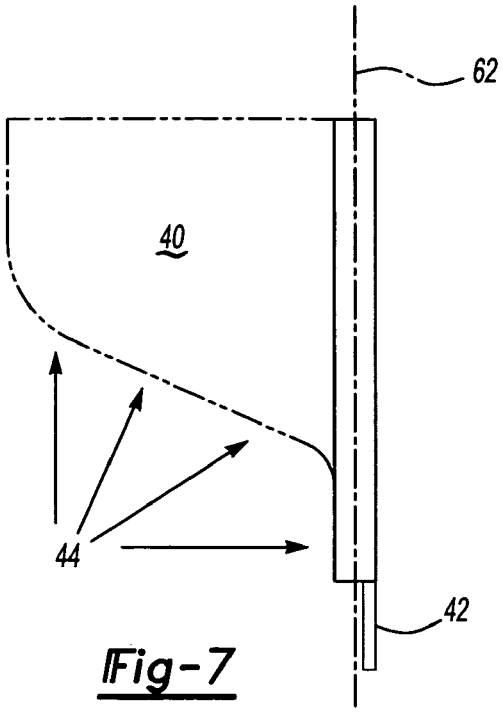
FIG. 7 is a side view of a template representing relative motion between the stamping die and the end tool.

Referring to FIG. 7 a template 40 is used to check clearance between the end tool 20 and the upper die portion 16 before installation of the stamping dies 14. The template 40 is constructed from a lightweight and easily formed material such as foam, wood, or even paper products. The template 40 includes a first surface 44 that represents relative movement between the end tool 20 and upper die portion 16 during movement toward the stamping die 14 toward the grasp position 25.

Figure 8:
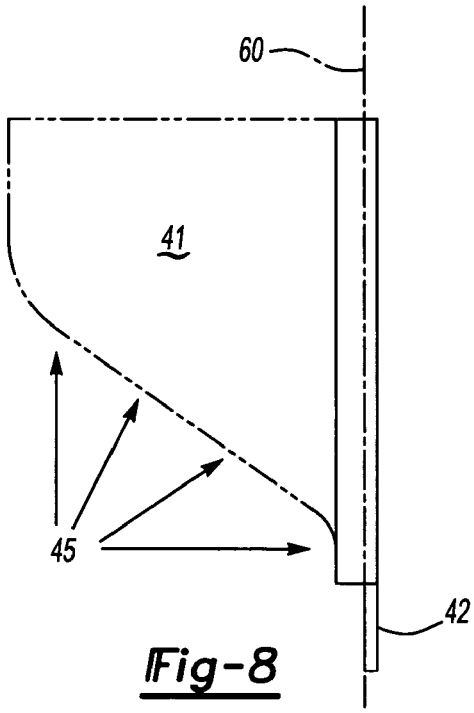
FIG. 8 is a side view of another template representing relative motion between the stamping die and the end tool.

Referring to FIG. 8, a second template 41 includes a second surface 45 representing movement away from the stamping die 14 away from the release position 27. The specific shape and contour of the surfaces 44, 45 for each of the templates 40,41 represent movement between the specific stamping die 14 and the end tool 20.

Figure 9A:
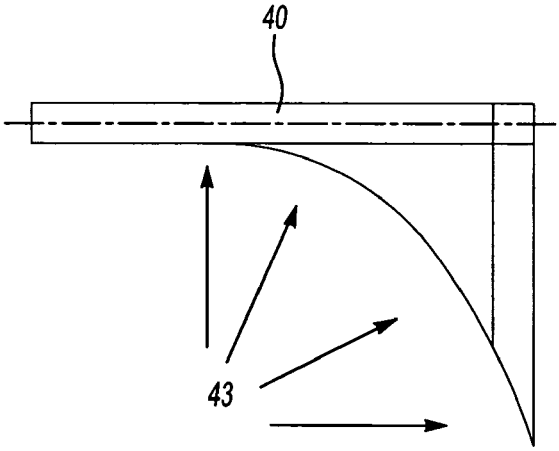
FIG. 9A is a top view of the template shown in FIG. 7

Referring to FIG. 9A, a top view of the template 40 is shown and includes a surface 43.

The surface 43 represents movement of the end tool 20 away from the grasp position 25. As previously shown in FIG. 3, the end tool 20 is in continuous motion to optimize cycle time. The motion of the end tool 20 incorporates movement along three axes. The surface 43 represents motion of the end tool along the transfer path 30. Alternatively, the surface 43 represent motion of the end tool 20 during transition between the lowering portion 29 to the return portion 32 of the path 31.

Figure 9B:
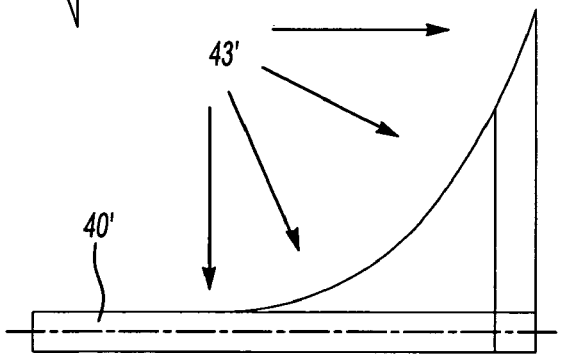
FIG. 9B is a top view of another template according to this invention.

Referring to FIG. 9B, a top view of the template 40' is shown and includes a surface 43'. The surface 43' represents movement of the end tool toward the grasp position 25 (FIG. 3). As appreciated, the template 40 can be shaped to represent movement along any portion of the end tool 20 path as is shown in FIG. 3.

Figure 10:
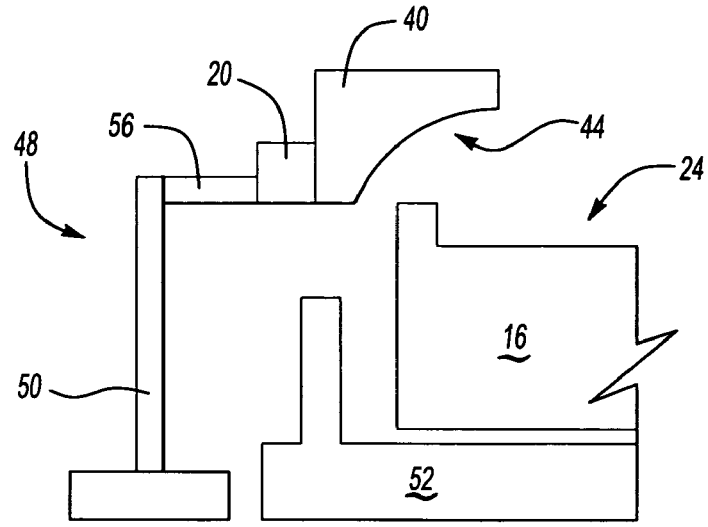
FIG. 10 is schematic view of the template supported relative to the stamping die.

Referring to FIG. 10, a die check assembly 48 includes a stand 50 for positioning one of the templates 40,41 relative to an upper die portion 16. Each of the templates includes a holder 42 for positioning relative to the end tool 20. The holder 42 illustrated is a rod extending downward from the template 40. However, holder 42 can be of any configuration required to attach and secure the template 40 to the end tool 20.

The stand 50 is adjustable to support the end tool 20 in a position duplicating either the grasp position 25 or the release position 27 depending on which of the templates 40,41 and end tool movements are being checked. The surface 44 duplicates the relative motion between the end tool 20 and the stamping die 16 during operation. The stand 50 includes an arm 56 that extends the end tool 20 outward toward the upper portion 16 of the stamping die 14. The upper portion 16 of the stamping die 14 is supported on an upper die member 52. As appreciated the upper die member 52 provides for the duplication of the relative position between the upper die portion 16 and the template 40. The position of the template 40 relative to the upper die portion 16 in the die check assembly 48 duplicates the relationship between the upper die portion 16 and the end tool 20 during operation. Contact between the template 40 and the stamping die 16 indicates possible contact during operation.

Although the illustrated example shows the upper die portion 16, the lower die portion 18 may also be checked for possible interference conditions with the end tool 20.

Figure 11:
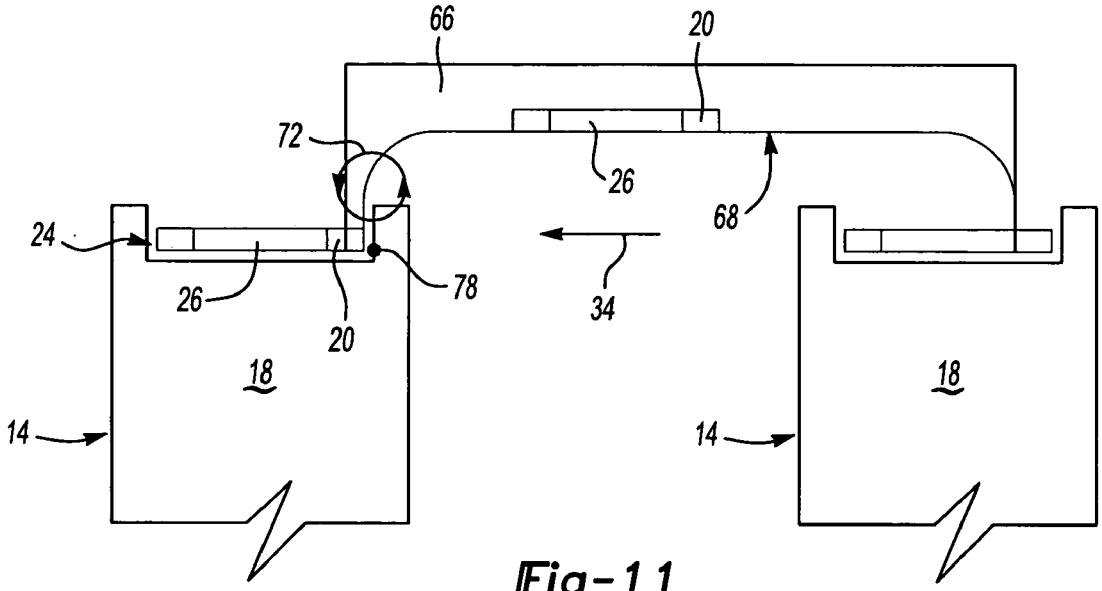
FIG. 11 is a schematic view of a template representing movement of the end tool between stamping dies.
Figure 12:
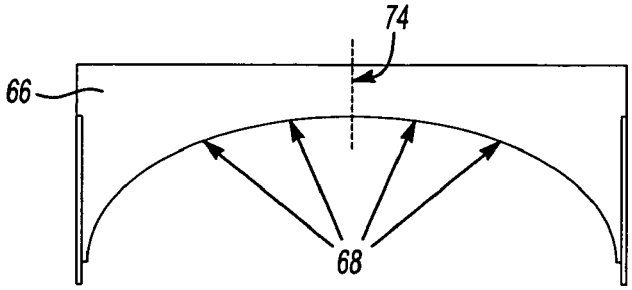
FIG. 12 is a schematic view of the template of FIG. 11 without the stamping dies.

Referring to FIGS. 11 and 12, another template 66 represents movement of the end of arm tooling 20 between stamping dies 14. The template 66 includes a surface 68 that represents movement of the end of arm tool 20 along the path 31 of end of arm tooling 20. The surface 68 of the template 66 can represents movement of the end of arm tool 20, the workpiece 26,or both. As appreciated, during movement of the workpiece 26 between stamping dies 14, the shape and configuration of the workpiece 26 can also cause a possible interference condition with the stamping die 14. The template 66 is therefore, preferably, used to check clearance during movement of the end tool 20 while moving the workpiece 26.

The surface 68 of the template 66 includes segments 72 that represent movement of the end tool 20 and the workpiece 26 entering the stamping die 14. The template 74 can be separated along a parting line 74 such that only that portion of the template 66 corresponding to a specific stamping die 14 can be used. In this way, the template 66 can be used to check clearances of a single stamping die 14 without necessitating alignment and fixing of multiple stamping dies 14 relative to each other as arranged in the stamping line 10. The template 66 includes a surface 76 that corresponds to a known surface or datum 78 of the stamping die 14 in order to properly orientate the template 66 and thereby the surface 68.

Figure 13:
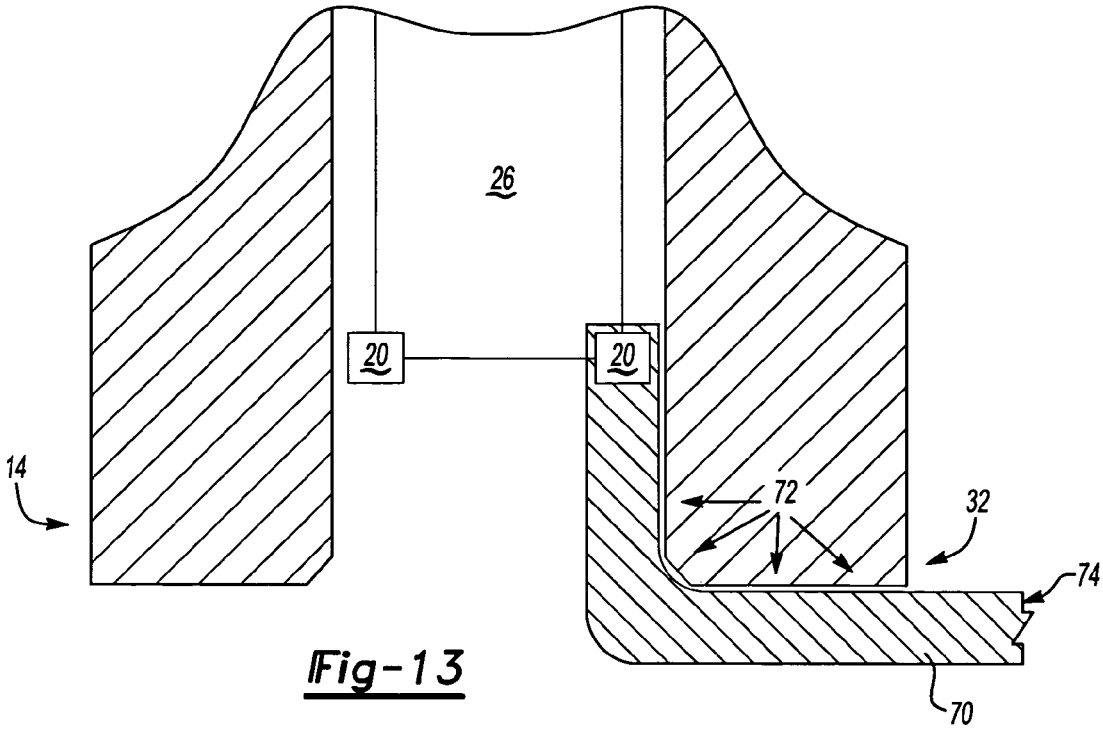
FIG. 13 is a schematic view of another template representing movement of the end tool within a horizontal plane during movement into the stamping die.
Figure 14:
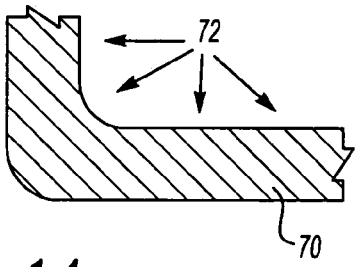
FIG. 14 is a schematic view of a portion of the template shown in FIG. 13.

Referring to FIGS. 13 and 14, another template 70 is schematically shown in relation to the stamping die 14. The template 70 and represents movement of the end tool 20 and workpiece 26 in a horizontal plane along the path 31 (FIG. 3). The path of travel of the workpiece 26 between stamping dies 14 preferably combines movement along different planes to provide the optimal path for transfer. The optimal transfer path is a curved path and is represented by the surface 72 of the template 70. The template 70 represents the transition from the return portion 32 of the path 31 toward the grasp position 25.

Figure 15:
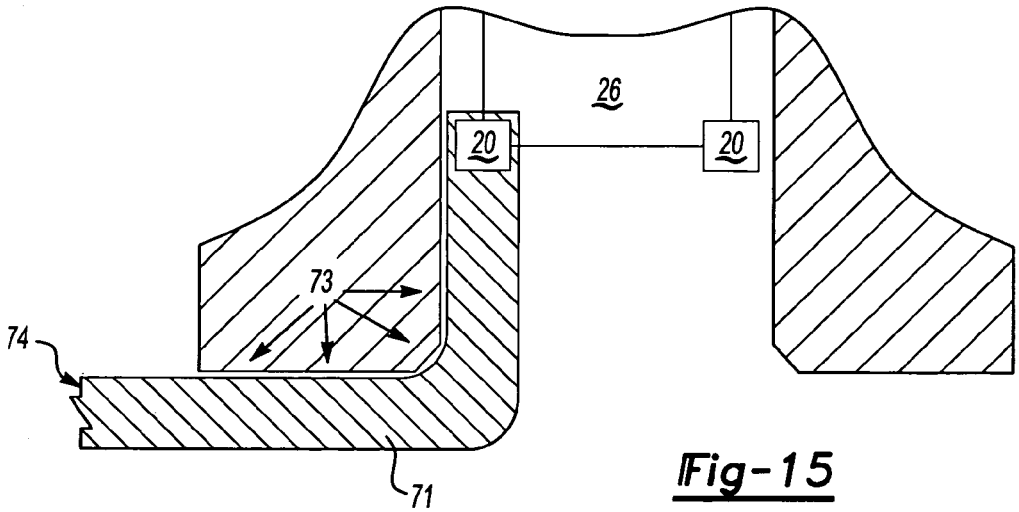
FIG. 15 is a schematic view of another template representing movement of the end tool during movement out of the stamping die.

Referring to FIG. 15, another template 71 is shown that includes a surface 73 that represents the portion of path 31 representing the transition from the release position 27 into the return portion 32 (FIG. 3). The portion of the path 31 represented by the template 71 is indicative of movement of the end tool 20 and the workpiece 26. The surfaces 72, and 73 represent the curvilinear path of the end tool 20 and the workpiece 26 during movement toward and away from the stamping die 14.

The specific shape of the surfaces 72, 73 are dependent on the specific application. Further, the templates 70, and 71 may be fabricated from any type of material, although preferably a lightweight substantially rigid material such as wood, foam or paper products is preferred to facilitate transport to offsite locations.

The operation and method for checking clearances between the end tool 20, workpiece 26 and stamping dies 14 can include the use of all or only one of the various templates described within this disclosure. A worker skilled in the art with the benefit of this disclosure will understand the specific application of each template to checking clearances between stamping dies and the end tool.

Referring to FIG. 10, the clearance between the stamping die 14 and the end tool 20 is checked by first positioning the template 40 representative of relative movement between the stamping dies to the end tool 20. The end tool 20 is then placed in a position that duplicates a position along the path 31 relative to the upper die 16. A contact or crash condition is determined if any portion of the template 40 contacts the stamping die 16 during the movement from the home position toward the stamping die 14.

Referring to FIG. 11, the clearance between the stamping die 14 and the end tool 20 with a workpiece 26 during transfer is checked by first aligning the point 76 of the template 66 with a datum 78 or other reference point on the stamping dies 14. The template 66 may be used with two stamping dies 14 arranged at a relative distance representing a final position in the stamping line 10 or may be a single stamping die 14. If two stamping dies 14 are used, the full template is mounted to datums 78 of each stamping die 14. The surface 68 is then observed, and any contact between the surface 68 and the stamping die 14 would indicate possible contact between the end tool 20, workpiece and stamping die 14. Checking for possible contact with only one die would require only a portion of the template 66 to check movement of the end tool 20 and workpiece through the segments 72.

Referring to FIG. 13, horizontal clearance between the stamping die 14 and the end tool 14 can then be checked using template 70. The template 70 is aligned relative to the stamping die 14 and the workpiece 26 and the relationship between the surface 72 and stamping die 14 observed. Any contact between the surface 72 and the stamping die 14 indicates possible contact during operation.

The method and devices of this invention provide a means of checking clearances between the end tool 10 and stamping die 14 before the stamping die 14 and the end tool 20 are fully assembled. Early detection and confirmation of clearance between the end tool 20 and stamping die 16 substantially eliminates delays caused by contact conditions of the stamping line assembly and transfer line assembly.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A method of checking clearance between a stamping die and a workpiece transfer system end tool, said method comprising the steps of:

a) placing the end tool into a position relative to the stamping die;

b) positioning a template representative of relative movement between the stamping die and the end tool on the end tool; and c) indicating contact between the end tool and the stamping die during operation of the stamping die and workpiece transfer system in response to any part of said template contacting the stamping die.

2. The method as recited in claim 1, including supporting a portion of the stamping die on a reference plane, and supporting said end tool on a stand in a predetermined position relative to said die.

3. The method as recited in claim 2, wherein the predetermined position duplicates a position of the end tool relative to the stamping die with said end tool assembled within the workpiece transfer system.

4. The method as recited in claim 1, wherein said template represents movement between the end tool and the stamping die in two dimensions.

5. The method as recited in claim 1, wherein said template represents movement between the end tool and the stamping die in three dimensions.

6. The method as recited in claim 1, wherein said template represents relative movement between said stamping die and said end tool along a return path toward a grasping position where the end tool grasps the workpiece.

7. The method as recited in claim 1, wherein said template represents relative movement between the stamping die and said end tool along a transfer path toward a release position where the end tool releases a workpiece.

8. A method of checking clearance between a stamping die and a workpiece transfer system end tool, said method comprising the steps of:

a.) positioning a template comprising a surface representative of relative movement between the stamping die and the end tool relative to a portion of a stamping die; and b.) indicating that the end tool will contact the stamping die in response to a portion of surface of the template contacting said stamping die.

9. The method as recited in claim 8, wherein the surface represents movement between the end tool and the stamping die in two dimensions.

10. The method as recited in claim 9, wherein the surface represents movement between the end tool and the stamping die in three dimensions.

11. The method as recited in claim 8, wherein the surface of the template represents relative movement of the end tool moving toward a grasp position where the end tool grasps a workpiece.

12. The method as recited in claim 8, wherein the surface of the template represents relative movement of the end tool moving away from a release position where the end tool releases a workpiece.

13. The method as recited in claim 8, wherein the surface of the template represents relative movement within a vertical plane between the end tool and the stamping die.

14. The method as recited in claim 8, wherein the surface of the template represents relative movement within a horizontal plane between the end tool and the stamping die.

15. The method as recited in claim 8, wherein said template represents relative movement of the end tool between two stamping dies.

* * * * *